US011264147B2

(12) United States Patent
Toda

(10) Patent No.: US 11,264,147 B2
(45) Date of Patent: Mar. 1, 2022

(54) CABLE ASSEMBLY

(71) Applicant: Japan Aviation Electronics Industry, Limited, Tokyo (JP)

(72) Inventor: Kentaro Toda, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 106 days.

(21) Appl. No.: 16/903,636

(22) Filed: Jun. 17, 2020

(65) Prior Publication Data

US 2021/0020330 A1 Jan. 21, 2021

(30) Foreign Application Priority Data

Jul. 18, 2019 (JP) ..... JP2019-132791

(51) Int. Cl.

| | |
|---|---|
| ***H01B 11/06*** | (2006.01) |
| ***H01B 11/12*** | (2006.01) |
| ***H01B 7/18*** | (2006.01) |
| ***H01B 7/00*** | (2006.01) |
| ***H01B 7/02*** | (2006.01) |
| ***H01B 7/17*** | (2006.01) |
| ***H01R 4/60*** | (2006.01) |

(Continued)

(52) U.S. Cl.

CPC ..... *H01B 7/17* (2013.01); *H01B 11/22* (2013.01); *H01R 4/60* (2013.01); *H01R 25/003* (2013.01)

(58) Field of Classification Search

CPC ..... H01B 7/0045; H01B 7/1815; H01B 7/17; H01B 7/0892; H01B 7/0853; H01B 7/0823; H01B 7/08; H01B 7/02; H01B 11/06; H01B 11/125; H01B 11/12; H01R 25/003; H01R 4/60

See application file for complete search history.

(56) References Cited

U.S. PATENT DOCUMENTS 5,053,583 A * 10/1991 Miller ..... H01B 11/20 174/36
5,162,611 A * 11/1992 Nichols, III ..... H01B 7/0823 174/115

(Continued)

FOREIGN PATENT DOCUMENTS

JP H09-330621 A 12/1997
JP 2001-076542 A 3/2001

(Continued)

*Primary Examiner* — Hoag C Nguyen
*Assistant Examiner* — Amol H Patel
(74) *Attorney, Agent, or Firm* — Collard. & Roe, P.C.

(57) ABSTRACT

A cable assembly extends in a longitudinal direction. The cable assembly comprises a first cable, two second cables, two coupling portions, an interposing portion and an outer cover. The first cable has a first conductor and a first cover. Each of the second cables has a second conductor and a second cover. The coupling portions couple the second covers, respectively, with the first cover. The first cable, the two second cables and the two coupling portions are arranged in a V-shape in a plane perpendicular to the longitudinal direction. The interposing portion extends along the first cable and the two second cables and has a full length which is equal to that of each of the first cable and the two second cables. The interposing portion is brought into contact with all the first cable and the two second cables.

5 Claims, 7 Drawing Sheets

(51) Int. Cl.
*H01R 25/00* (2006.01)
*H01B 11/22* (2006.01)

(56) References Cited

U.S. PATENT DOCUMENTS

| | | | | | |
|---|---|---|---|---|---|
| 5,428,187 | A * | 6/1995 | Crane | H01B 7/0861 | 174/115 |
| 5,428,189 | A * | 6/1995 | Dorner | B60R 16/0207 | 174/115 |
| 5,463,186 | A * | 10/1995 | Schricker | H01B 7/0846 | 174/113 R |
| 5,834,698 | A * | 11/1998 | Izui | H01B 9/003 | 174/113 R |
| 10,002,691 | B1 * | 6/2018 | Salz | H01B 11/203 | |
| 2014/0116750 | A1 * | 5/2014 | Suzuki | H01B 7/0823 | 174/117 F |
| 2016/0351294 | A1 * | 12/2016 | Tsai | H01B 7/0853 | |

FOREIGN PATENT DOCUMENTS

| | | | |
|---|---|---|---|
| JP | 2008-053143 | A | 3/2008 |
| JP | 2011-081089 | A | 4/2011 |

* cited by examiner

CABLE ASSEMBLY

CROSS REFERENCE TO RELATED APPLICATIONS

This application is based on and claims priority under 35 U.S.C. § 119 to Japanese Patent Application No. JP2019-132791 filed Jul. 18, 2019, the contents of which are incorporated herein in their entirety by reference.

BACKGROUND OF THE INVENTION

This invention relates to a cable assembly.

JPA2011-81089 (Patent Document 1) discloses a cable assembly 900 of this type. As understood from FIGS. 12 and 13, the cable assembly 900 of Patent Document 1 comprises four optical fiber cables 910 and three connecting portions 920, or three coupling portions 920. Each of the optical fiber cables 910 has an optical fiber element wire 912 and a sheath 914. The coupling portion 920 couples the sheaths 914 of the optical fiber cables 910 with each other.

One possible modification of the cable assembly 900 of Patent Document 1 is to replace the optical fiber cables 910 with insulated conductors. Specifically, the modified cable assembly is configured so that the insulated conductors are coupled with each other by coupling portions such as the coupling portions 920 of Patent Document 1.

On a different note, there is a need for a cable assembly, which consists of insulated conductors, to maintain a distance between conductors of the insulated conductors at a predetermined distance in a manner similar to, for example, that of conductors used for differential signal transmission.

Referring to FIG. 13, in the modified cable assembly whose insulated conductors are coupled with each other by the coupling portions similar to the coupling portions 920 of Patent Document 1, a distance between conductors of the insulated conductors in a Y-direction depends on a thickness of a cover of the insulated conductors. In a case where the modified cable assembly is required to have an increased distance between the conductors, it is necessary for the cover to have an increased thickness. In other words, enlargement of the modified cable assembly itself cannot be avoided in this case.

SUMMARY OF THE INVENTION

It is therefore an object of the present invention to provide a cable assembly which can maintain a distance between conductors at a predetermined distance without increasing a size of the cable assembly.

One aspect of the present invention provides a cable assembly extending in a longitudinal direction. The cable assembly comprises a first cable, two second cables, two coupling portions, an interposing portion and an outer cover. The first cable has a first conductor and a first cover. The first cover covers the first conductor. The two second cables are positioned apart from each other in a first direction perpendicular to the longitudinal direction. Each of the second cables is positioned apart from the first cable in a second direction perpendicular to both the longitudinal direction and the first direction. Each of the second cables has a second conductor and a second cover. The second cover covers the second conductor. The coupling portions couple the second covers, respectively, with the first cover. The first cable, the two second cables and the two coupling portions are arranged in a V-shape in a plane perpendicular to the longitudinal direction. The interposing portion extends along the first cable and the two second cables and has a full length which is equal to that of each of the first cable and the two second cables. The interposing portion is brought into contact with all the first cable and the two second cables. The outer cover is brought into contact with all the first cable and the two second cables.

The cable assembly of the present invention comprises the first cable, the two second cables, the two coupling portions, the interposing portion and the cover, wherein the interposing portion is brought into contact with all the first cable and the two second cables. This enables the cable assembly of the present invention to maintain a distance between the first conductor of the first cable and the second conductor of the second cable at a predetermined distance without increasing a size of the cable assembly. In addition, this also enables the cable assembly of the present invention to maintain another distance between the second conductors of the two second conductors at another predetermined distance without increasing the size of the cable assembly.

An appreciation of the objectives of the present invention and a more complete understanding of its structure may be had by studying the following description of the preferred embodiment and by referring to the accompanying drawings.

Figure 1:
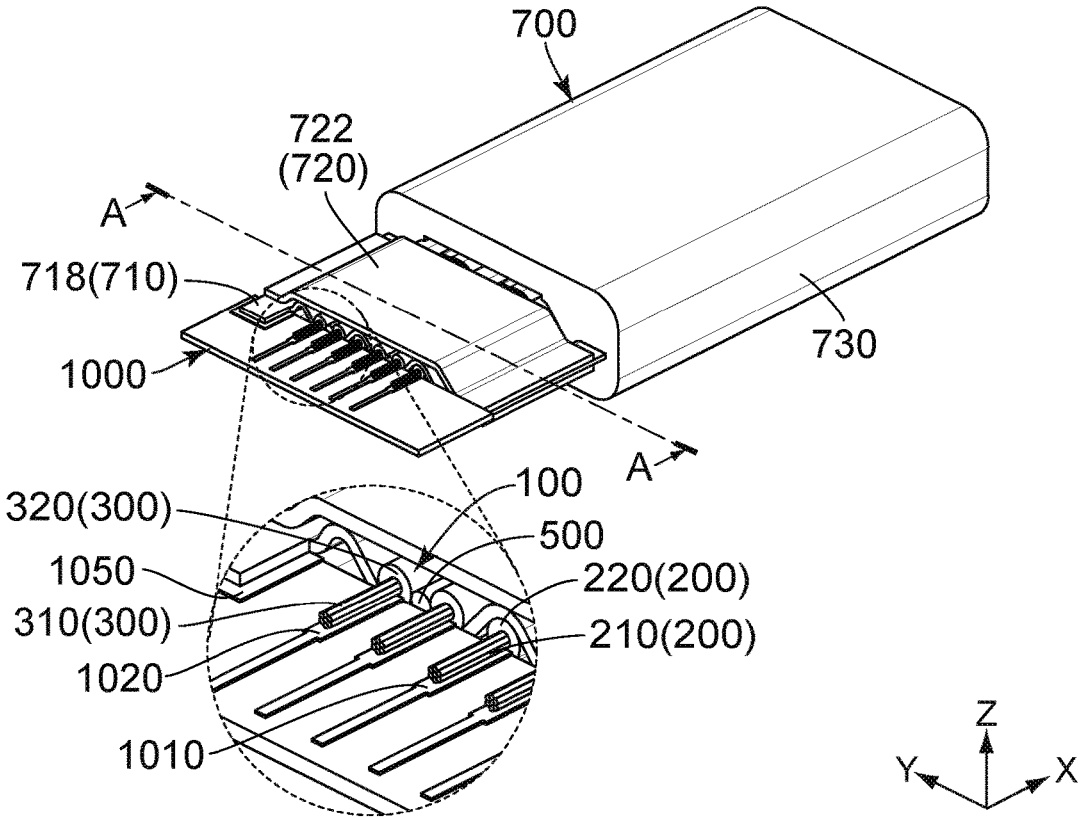
FIG. 1 is a perspective view showing a connecting structure using cable assemblies according to an embodiment of the present invention, wherein a first conductor and second conductors of the cable assembly are connected with pads of a circuit board. In the figure, parts of the connecting structure and the circuit board are illustrated enlarged.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 8:
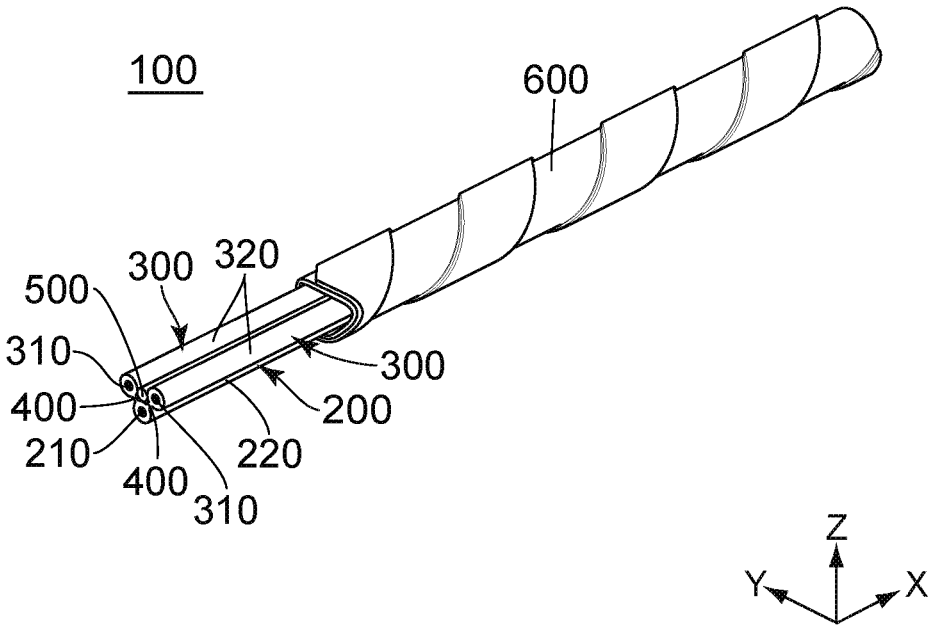
FIG. 8 is a perspective view showing the cable assembly of FIG. 6.

As shown in FIG. 8, a cable assembly 100 according to an embodiment of the present invention extends in a longitudinal direction. In the present embodiment, the longitudinal direction is an X-direction. Specifically, it is assumed that forward is a negative X-direction while rearward is a positive X-direction.

Figure 6:
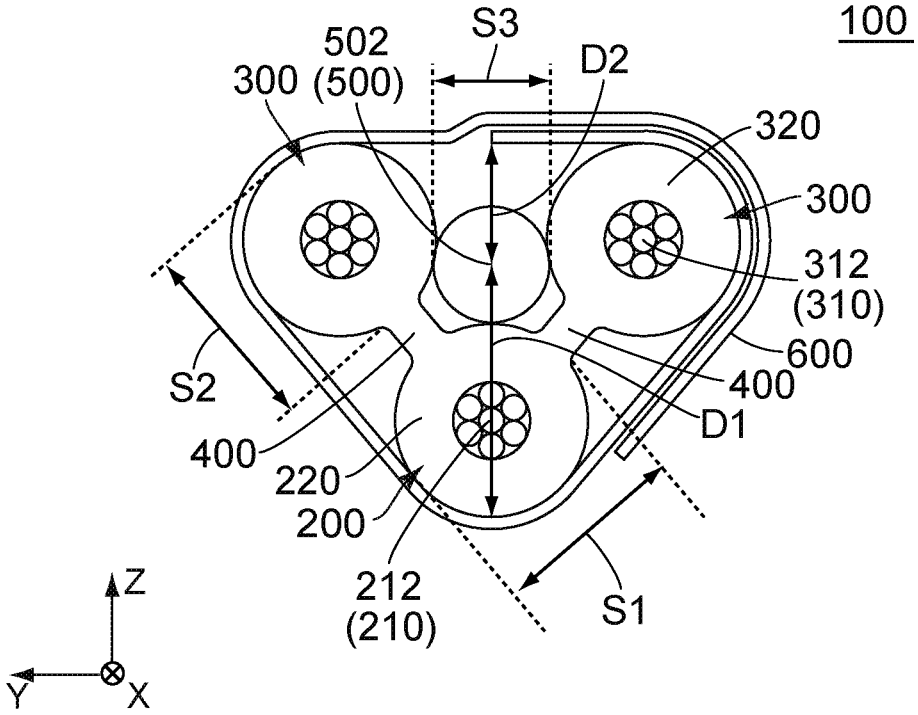
FIG. 6 is a front view showing the cable assembly which is included in the connecting structure of FIG. 2.

As shown in FIG. 6, the cable assembly 100 of the present embodiment comprises a first cable 200, two second cables 300, two coupling portions 400, an interposing portion 500 and an outer cover 600.

Referring to FIG. 6, the first cable 200 of the present embodiment is used for grounding. The first cable 200 has a first conductor 210 and a first cover 220. The first cover 220 covers the first conductor 210.

As shown in FIG. 6, the two second cables 300 are positioned apart from each other in a first direction perpendicular to the longitudinal direction. In the present embodiment, the first direction is a Y-direction.

As shown in FIG. 6, each of the second cables 300 is positioned apart from the first cable 200 in a second direction perpendicular to both the longitudinal direction and the first direction. In the present embodiment, the second direction is a Z-direction. Specifically, it is assumed that upward is a positive Z-direction while downward is a negative Z-direction.

Referring to FIG. 6, the second cables 300 of the present embodiment are used for differential signal transmission. Each of the second cables 300 has a second conductor 310 and a second cover 320. The second cover 320 covers the second conductor 310.

Referring to FIG. 6, each of the coupling portions 400 of the present embodiment is made of resin and is elastically deformable. The coupling portions 400 couple the second covers 320, respectively, with the first cover 220. The first cover 220 of the first cable 200, the second covers 320 of the second cables 300 and the coupling portions 400 are integrally formed with each other.

As shown in FIG. 6, the first cable 200, the two second cables 300 and the two coupling portions 400 are arranged in a V-shape in a plane perpendicular to the longitudinal direction. More specifically, the first cable 200 defines a lower end of the V-shape, and the second cables 300 define open ends of the V-shape.

Referring to FIGS. 6 and 8, the interposing portion 500 of the present embodiment is made of resin. However, the present invention is not limited thereto. The interposing portion 500 may be a cable having a conductor, or may be an optical fiber.

As understood from FIGS. 6 and 8, the interposing portion 500 has a cylindrical shape. However, the present invention is not limited thereto. The interposing portion 500 may have a prism shape. The interposing portion 500 extends along the first cable 200 and has a full length which is equal to that of the first cable 200. The interposing portion 500 extends along the two second cables 300 and has the full length which is equal to that of each of the two second cables 300. The interposing portion 500 and the first cable 200 are arranged in the second direction. The interposing portion 500 is positioned between the second cables 300 in the first direction. The interposing portion 500 is provided separately from any of the first cable 200, the second cables 300 and the coupling portions 400.

As described above, the first cover 220 of the first cable 200, the second covers 320 of the second cables 300 and the coupling portions 400 are integrally formed with each other while the interposing portion 500 is provided separately from any of the first cable 200, the second cables 300 and the coupling portions 400. Accordingly, the interposing portion 500 having a variety of sizes can be arranged between the two second cables 300 after the integral formation of the first cover 220 of the first cable 200, the second covers 320 of the second cables 300 and the coupling portions 400. Thus, a distance between the second conductors 310 of the two second cables 300 can be easily changed.

As described above, the second cables 300 define the open ends of the V-shape. This enables the interposing portion 500 to be easily inserted into a space between the two second cables 300 from above when the interposing portion 500 is arranged between the two second cables 300. In addition, this also enables the interposing portion 500 to be easily replaced by an interposing portion 500 of another size from above upon its replacement by the interposing portion 500 of another size.

Since it can be easy to replace the interposing portion 500 or to change the distance between the two second cables 300 due to the replacement of the interposing portion 500 as described above, a characteristic impedance of the cable assembly 100 can be easily changed. Thus, without changing the integrated structure of the first cable 200, the second cables 300 and the coupling portions 400, the cable assembly 100 can be easily manufactured so that the characteristic impedance of the cable assembly 100 matches any of different characteristic impedances which are required by various standards, for example, a USB (Universal Serial Bus) standard and an HDMI (High-Definition Multimedia Interface) standard, wherein "HDMI" is a registered trademark.

As shown in FIG. 6, the interposing portion 500 is brought into contact with all the first cable 200 and the two second cables 300. Again, the cable assembly 100 is configured as follows: the interposing portion 500 is made of resin; and the interposing portion 500 extends along the first cable 200 and the two second cables 300 and has the full length which is equal to that of each of the first cable 200 and the two second cables 300. Accordingly, the interposing portion 500 can function as a reinforcing member for the cable assembly 100. In addition, this configuration can maintain relative positions of the first cable 200, the two second cables 300 and the interposing portion 500 over a full length of the cable assembly 100. Thus, the cable assembly 100 can be prevented from having locally different characteristics.

Referring to FIG. 6, a size S3 of a cross-section, which is perpendicular to the longitudinal direction, of the interposing portion 500 is smaller than a size S1 of a cross-section, which is perpendicular to the longitudinal direction, of the first cable 200. The size S3 of the cross-section, which is perpendicular to the longitudinal direction, of the interposing portion 500 is smaller than a size S2 of a cross-section, which is perpendicular to the longitudinal direction, of the second cable 300.

Figure 7:
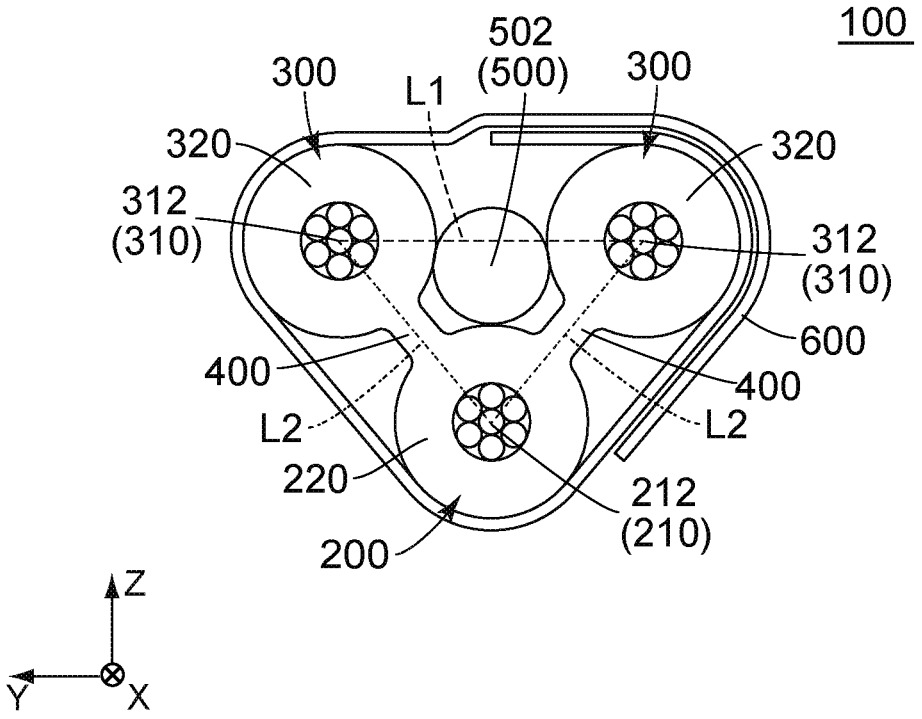
FIG. 7 is a reproduction of FIG. 6.

As shown in FIG. 7, a center 502 of the interposing portion 500 is positioned between the second conductors 310 of the second cables 300 in the first direction. Additionally, in the second direction, the center 502 of the interposing portion 500 is positioned between a center 212 of the first conductor 210 and a line L1 which connects centers 312 of the second conductors 310 of the second cables 300 with each other.

As shown in FIG. 7, the line L1, which connects the centers 312 of the second conductors 310 of the second cables 300 with each other, and a line L2, which connects the center 212 of the first conductor 210 with the center 312 of the second conductor 310, make an acute angle with each other. The line L2, which connects the center 212 of the first conductor 210 with the center 312 of one of the second conductors 310, and the line L2, which connects the center 212 of the first conductor 210 with the center 312 of a remaining one of the second conductors 310, make an acute angle with each other.

As shown in FIG. 7, the coupling portion 400 is positioned on the line L2 which connects the center 212 of the first conductor 210 with the center 312 of the second conductor 310.

As shown in FIG. 6, the outer cover 600 of the present embodiment is brought into contact with all the first cable 200 and the two second cables 300. The outer cover 600 is in non-contact with the interposing portion 500.

As shown in FIG. 6, the cable assembly 100 has a first distance D1 which is a shortest distance through the center 212 of the first conductor 210 from the center 502 of the interposing portion 500 to the outer cover 600 in the second direction. In addition, the cable assembly 100 has a second distance D2 which is a shortest distance from the center 502 of the interposing portion 500 to the outer cover 600 without passing through the first conductor 210 in the second direction. The first distance D1 is greater than the second distance D2.

Referring to FIG. 1, hereinafter, description will be made about a connecting structure 700 of an embodiment using the cable assemblies 100 of the present embodiment.

As shown in FIG. 1, the connecting structure 700 of the present embodiment is connectable with an object such as a circuit board 1000. The circuit board 1000 has pads 1010, 1020 and fixing portions 1050.

Figure 2:
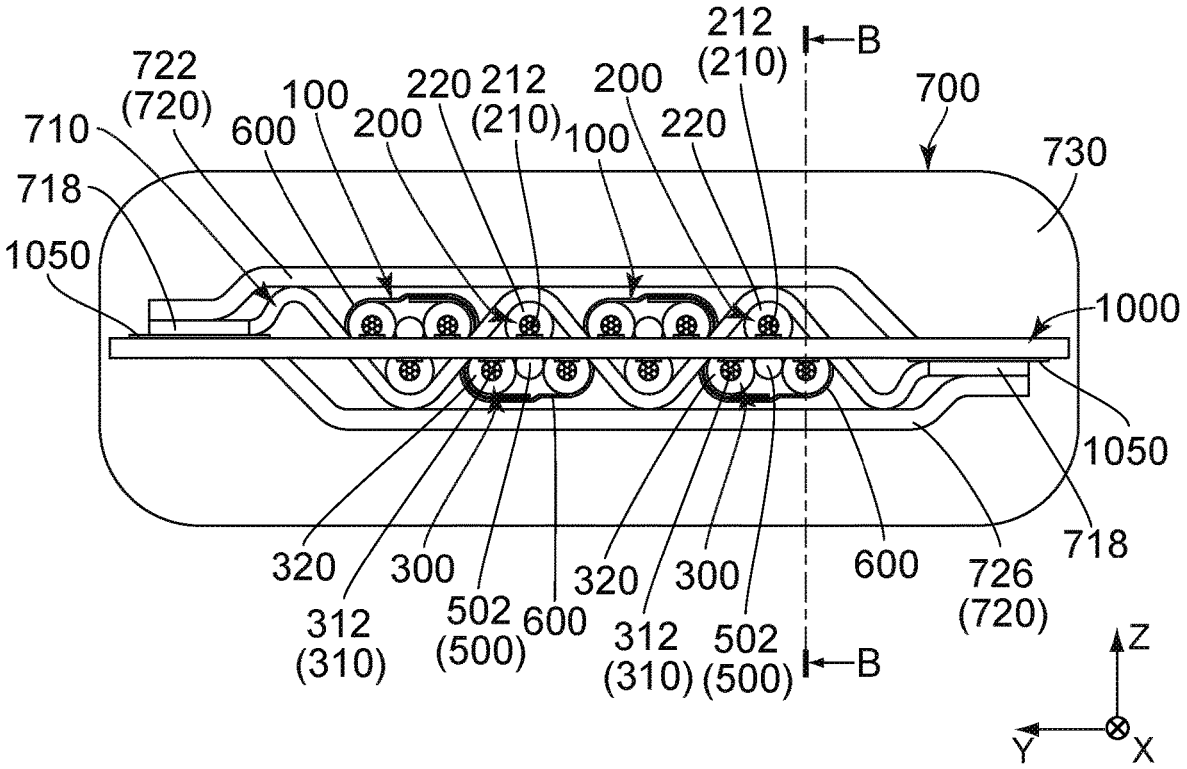
FIG. 2 is a front view showing the connecting structure of FIG. 1.
Figure 3:
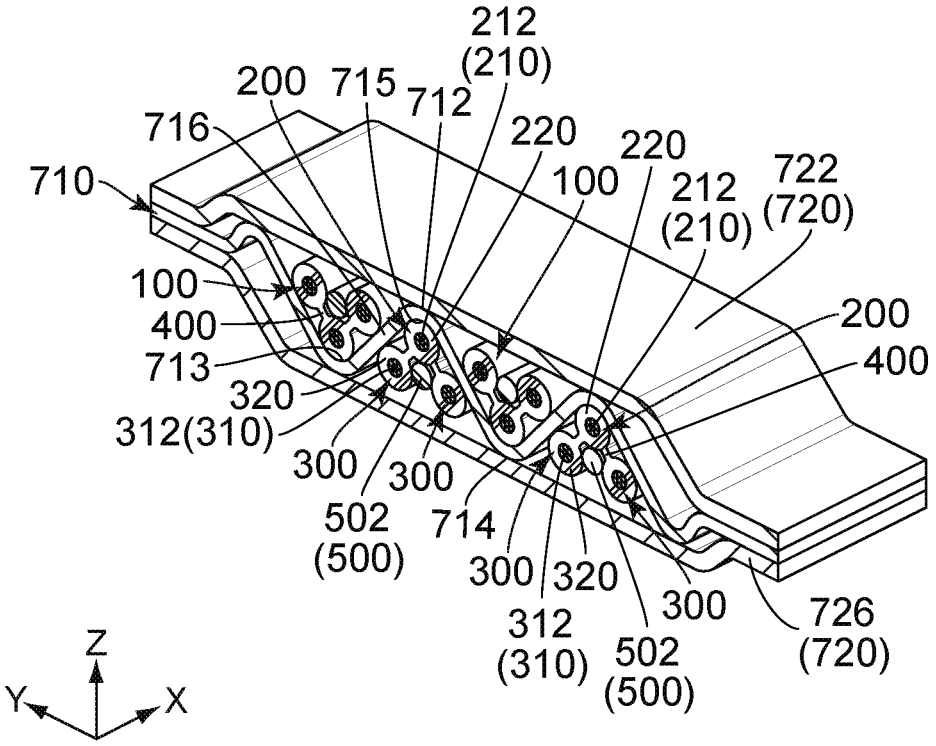
FIG. 3 is a perspective, cross-sectional view showing the connecting structure of FIG. 1, taken along line A-A. In the figure, a cable holding member and parts of the cable assemblies, which are held by the cable holding portion, are omitted.

As shown in FIG. 2, the connecting structure 700 of the present embodiment comprises four of the cable assemblies 100, a cable arranging member 710, a pressing member 720 and a cable holding member 730. However, the present invention is not limited thereto. The connecting structure 700 may be modified, provided that the connecting structure 700 comprises one or more of the cable assemblies 100.

Figure 4:
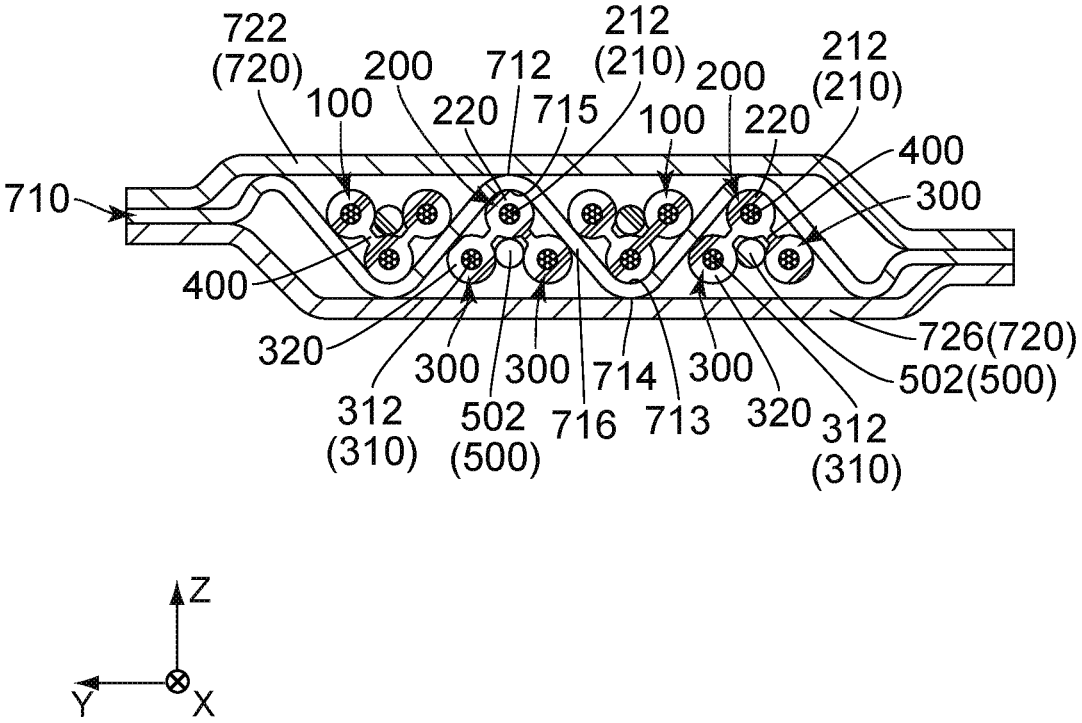
FIG. 4 is a front, cross-sectional view showing the connecting structure of FIG. 3.
Figure 5:
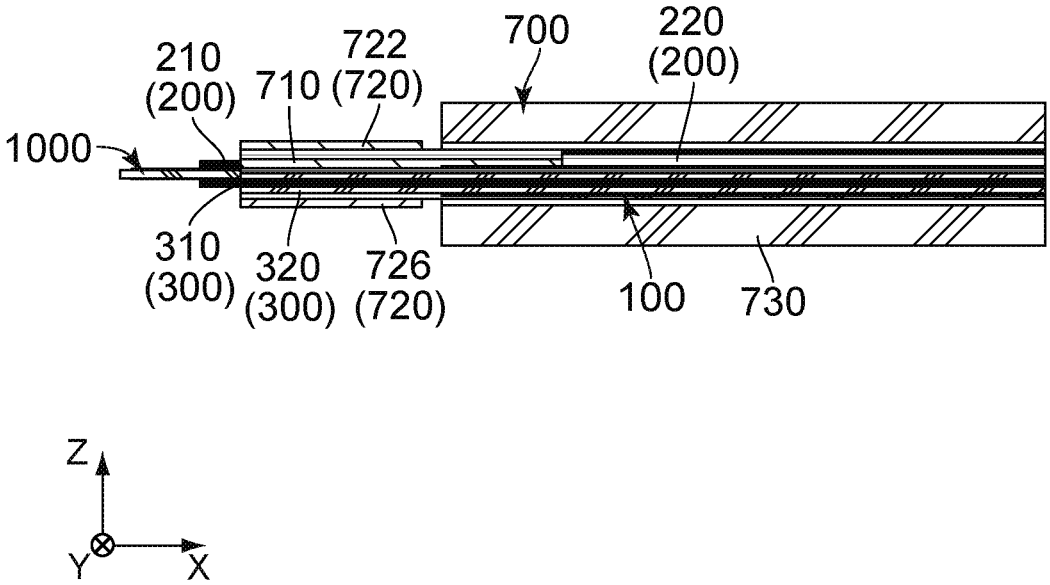
FIG. 5 is a cross-sectional view showing the connecting structure of FIG. 2, taken along line B-B.

As shown in FIG. 1, the cable arranging member 710 of the present embodiment is held by the cable holding member 730. As shown in FIG. 4, a part of the cable arranging member 710 has a corrugated shape in the plane perpendicular to the longitudinal direction. More specifically, the cable arranging member 710 has crest portions 712, valley portions 713, crest portions 714, valley portions 715, connecting portions 716 and fixed portions 718 (see FIG. 2). Each of the crest portions 712 protrudes upward. Each of the valley portions 713 is recessed downward. Each of the crest portions 714 protrudes downward. Each of the valley portions 715 is recessed upward.

As shown in FIG. 4, the connecting portion 716 of the present embodiment connects the crest portion 712 and the valley portion 713 with each other. In addition, the connecting portion 716 connects the crest portion 714 and the valley portion 715 with each other.

As shown in FIG. 1, each of the fixed portions 718 of the present embodiment has a flat-plate shape perpendicular to the second direction. Each of the fixed portions 718 is positioned at a front end of the cable arranging member 710 in the longitudinal direction.

As shown in FIG. 4, the pressing member 720 of the present embodiment is fixed to the cable arranging member 710. The pressing member 720 consists of an upper pressing portion 722 and a lower pressing portion 726.

As shown in FIG. 4, the upper pressing portion 722 of the present embodiment is fixed to the cable arranging member 710. The upper pressing portion 722 is positioned above the lower pressing portion 726 in the second direction. The upper pressing portion 722 is brought into contact with the crest portion 712 in the second direction.

As shown in FIG. 4, the lower pressing portion 726 of the present embodiment is fixed to the cable arranging member 710. The lower pressing portion 726 is positioned below the upper pressing portion 722 in the second direction. The lower pressing portion 726 is brought into contact with the crest portion 714 in the second direction.

As shown in FIG. 4, each of two of the cable assemblies 100 is positioned between the upper pressing portion 722 and the valley portion 713 in the second direction. Each of remaining two of the cable assemblies 100 is positioned between the lower pressing portion 726 and the valley portion 715 in the second direction. The first cable 200 of each of the two cable assemblies 100 is brought into contact with the valley portion 713 in the second direction. Each of the second cables 300 of the two cable assemblies 100 is brought into contact with the connecting portion 716. The first cable 200 of each of the remaining two cable assemblies 100 is brought into contact with the valley portion 715 in the second direction. Each of the second cables 300 of the remaining two cable assemblies 100 is brought into contact with the connecting portion 716.

As shown in FIGS. 1 and 2, the cable holding member 730 of the present embodiment holds the cable assemblies 100 altogether.

As shown in FIG. 1, the first conductor 210 of the first cable 200 of the cable assembly 100 is connected with the pad 1010 of the circuit board 1000 when the connecting structure 700 is connected with the circuit board 1000. The second conductor 310 of the second cable 300 of the cable assembly 100 is connected with the pad 1020 of the circuit board 1000 when the connecting structure 700 is connected with the circuit board 1000. The fixed portions 718 of the cable arranging member 710 are fixed to the fixing portions 1050, respectively, of the circuit board 1000 when the connecting structure 700 is connected with the circuit board 1000.

As shown in FIG. 2, the circuit board 1000 is positioned between the first conductor 210 of the first cable 200 and the second conductor 310 of the second cable 300 in the second direction when the connecting structure 700 is connected with the circuit board 1000.

As understood from FIG. 1, the interposing portion 500 extends to an immediate vicinity of parts of the first conductor 210 and the second conductor 310 which are configured to be connected with the pads 1010 and 1020 of the circuit board 1000 and which are exposed outside the cable assembly 100.

Since the connecting structure 700 of the present embodiment comprises the cable arranging member 710, the connecting structure 700 of the present embodiment arranges the cable assemblies 100 in close proximity in the first direction.

Again, the connecting structure 700 of the present embodiment is configured so that the interposing portion 500 extends to the immediate vicinity of the parts of the first conductor 210 and the second conductor 310 which are configured to be connected with the pads 1010 and 1020 of the circuit board 1000 and which are exposed outside the cable assembly 100. This configuration maintains the relative positions of the first cable 200 and the second cables 300 in the plane perpendicular to the longitudinal direction up to an immediate vicinity of the pads 1010 and 1020 when the connecting structure 700 is connected with the circuit board 1000. Thus, the connecting structure 700 is prevented from having degraded transmission characteristics when the connecting structure 700 is used for differential signal transmission.

Figure 9:
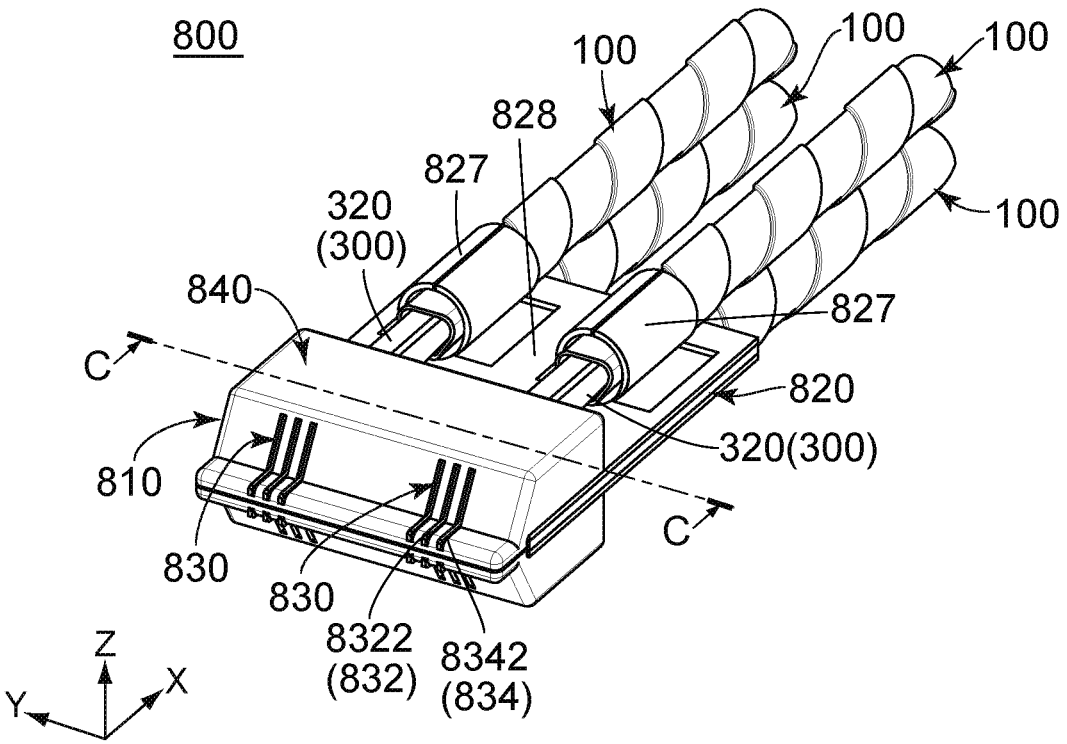
FIG. 9 is a perspective view showing a cable harness using the cable assemblies of the present embodiment.
Figure 10:
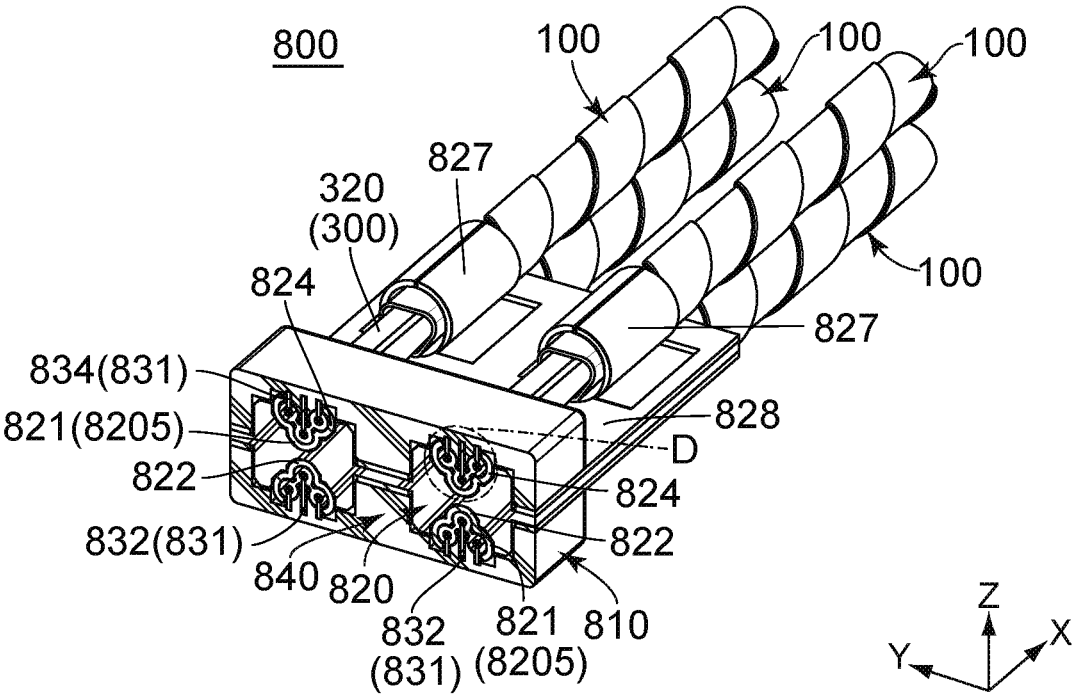
FIG. 10 is a perspective, cross-sectional view showing the cable harness of FIG. 9, taken along line C-C.
Figure 11:
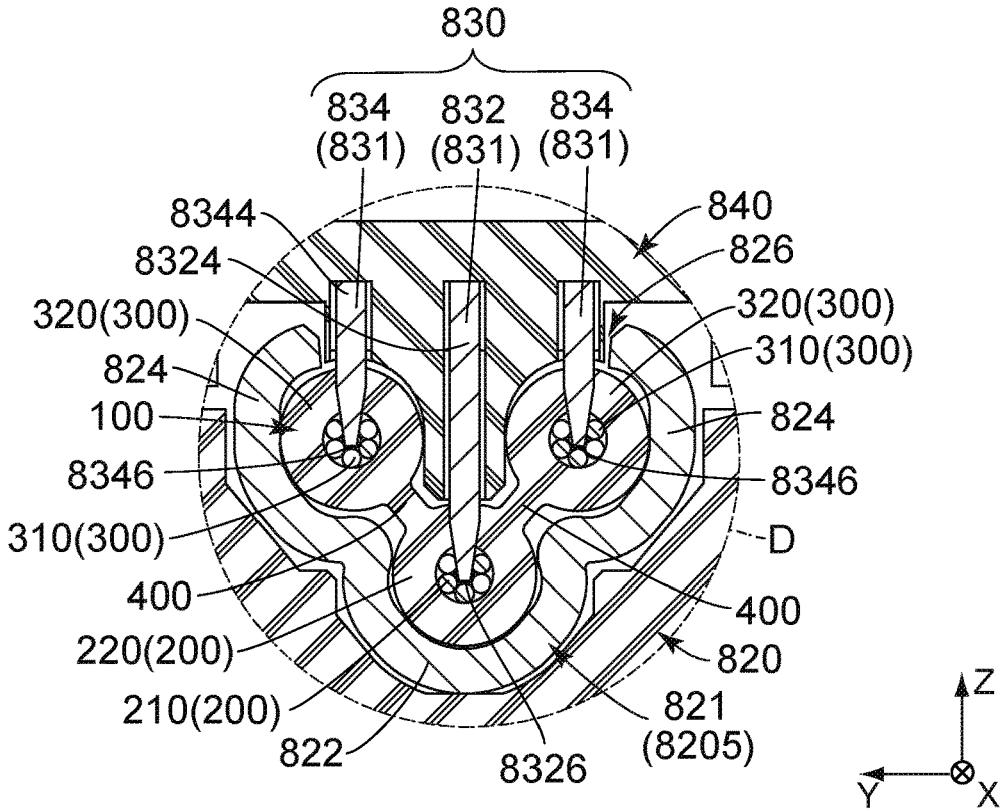
FIG. 11 is an enlarged end view showing a part of the cable harness which is enclosed by broken line D of FIG. 10.
Figure 12:
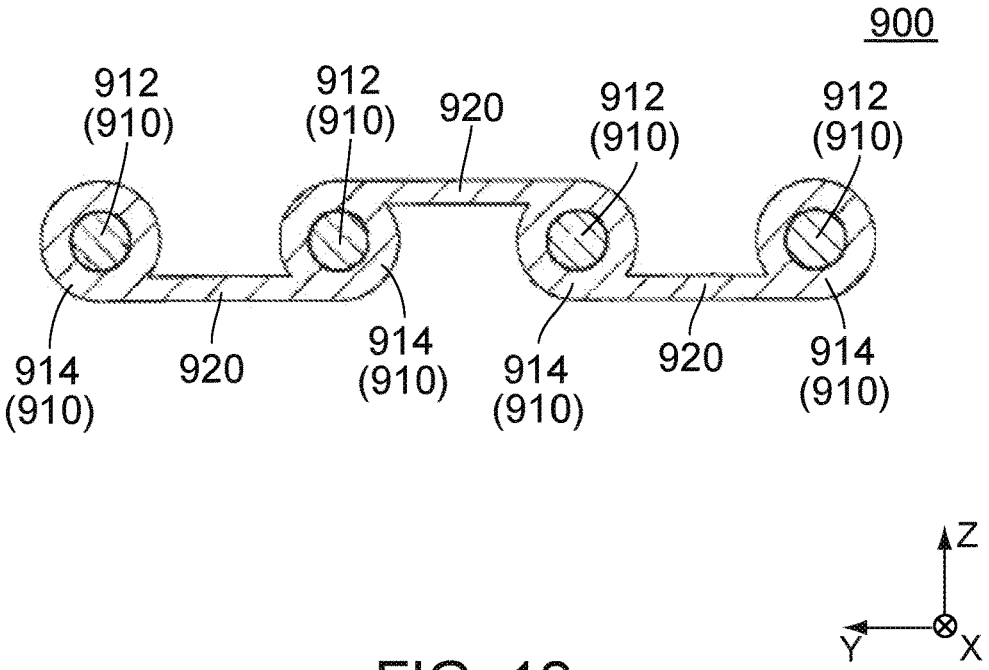
FIG. 12 PRIOR ART
FIG. 12 is a front, cross-sectional view showing a cable assembly of Patent Document 1.
Figure 13:
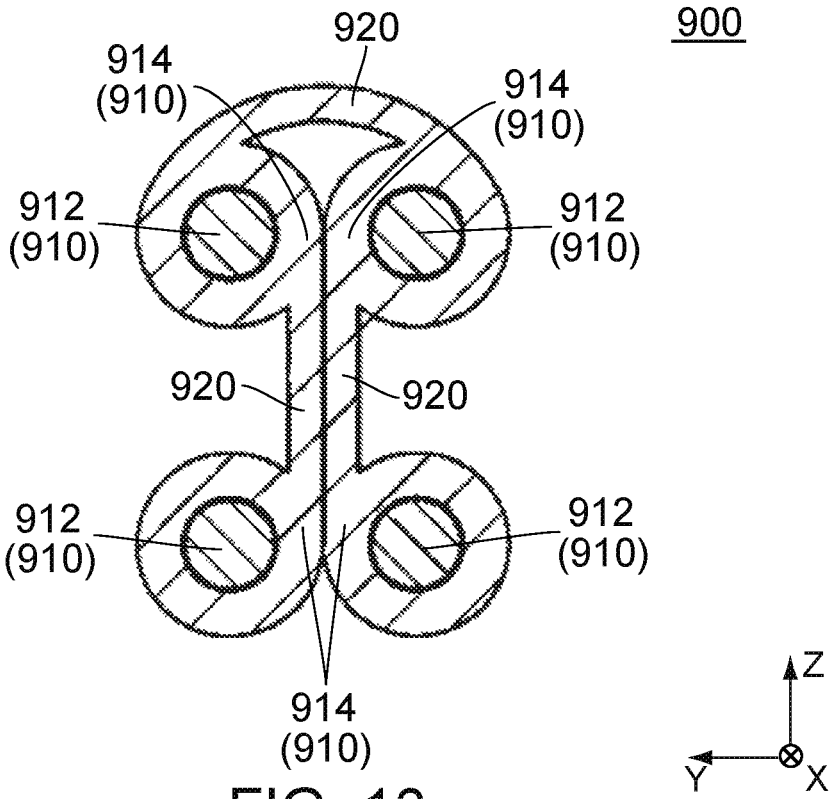
FIG. 13 PRIOR ART
FIG. 13 is another front, cross-sectional view showing the cable assembly of FIG. 12.

Referring to FIGS. 9 to 11, hereinafter, description will be made about a cable harness 800 of an embodiment using the cable assemblies 100 of the present embodiment.

As shown in FIG. 9, the cable harness 800 of the present embodiment comprises four of the cable assemblies 100 and a connector 810. However, the present invention is not limited thereto. The cable harness 800 may be modified, provided that the cable harness 800 comprises one or more of the cable assemblies 100.

Referring to FIG. 9, the connector 810 of the present embodiment is attached with the four cable assemblies 100 and is connectable with a mating connector (not shown) having mating contact portions (not shown).

As shown in FIGS. 10 and 11, the connector 810 of the present embodiment has a first member 820, a plurality of terminals 830 and second members 840.

As shown in FIG. 10, the first member 820 of the present embodiment is attached with the cable assemblies 100. The first member 820 has a base portion 828, a cable holding portion 8205 and cable assembly holding portions 827. Specifically, the base portion 828 has a flat-plate shape.

As shown in FIG. 10, the cable holding portion 8205 of the present embodiment is provided on the base portion 828. The cable holding portion 8205 has four holding portion sets 821 each of which comprises a first cable holding portion 822 and two second cable holding portions 824. The holding portion sets 821 correspond to the cable assemblies 100, respectively.

As shown in FIG. 11, the first cable holding portion 822 holds the first cable 200 when the first member 820 is attached with the cable assembly 100. The second cable holding portions 824 hold the second cables 300, respectively, when the first member 820 is attached with the cable assembly 100. In each of the holding portion sets 821, the first cable holding portion 822 and the second cable holding portions 824 have a common opening 826 which opens in the second direction.

As shown in FIG. 10, the cable assembly holding portions 827 hold the cable assemblies 100, respectively.

As shown in FIG. 11, the plurality of terminals 830 of the present embodiment are held by the second members 840. As understood from FIGS. 10 and 11, the plurality of terminals 830 include four terminal sets 831 each of which comprises a first terminal 832 and two second terminals 834. The terminal sets 831 correspond to the holding portion sets 821, respectively. The terminal sets 831 correspond to the cable assemblies 100, respectively.

Referring to FIGS. 9 and 11, each of the terminals 830 is made of metal. Specifically, each of the terminals 830 has a contact portion 8322, 8342, a held portion 8324, 8344 and a connecting portion 8326, 8346. More specifically, the first terminal 832 has the contact portion 8322, the held portion 8324 and the connecting portion 8326, while the second terminal 834 has the contact portion 8342, the held portion 8344 and the connecting portion 8346.

As shown in FIGS. 10 and 11, the connecting portion 8326, 8346 is connected with the cable assembly 100 when the connector 810 is attached with the cable assembly 100.

As shown in FIGS. 10 and 11, under a connected state where the connector 810 is connected with the cable assembly 100, the connecting portion 8326 of the first terminal 832 pierces the first cover 220 and is connected with the first conductor 210.

As shown in FIGS. 10 and 11, under the connected state where the connector 810 is connected with the cable assembly 100, the connecting portion 8346 of the second terminal 834 pierces the second cover 320 and is connected with the second conductor 310.

Referring to FIGS. 9 to 11, hereinafter, description will be made in detail about a method of attaching the connector 810 with the cable assemblies 100.

First, the outer cover 600 (see FIG. 6) is partly removed from the cable assembly 100 so that each of the first cable 200, the second cables 300 and the interposing portion 500 is partly exposed outside the cable assembly 100. Next, the exposed part of the interposing portion 500 is removed from the cable assembly 100 and the exposed parts of the first cable 200 and the second cables 300 are arranged outward in the second direction beyond the corresponding holding portion set 821 of the first member 820. Meanwhile, the cable assembly 100 is positioned outward in the second direction beyond an opening (not shown) of the corresponding cable assembly holding portion 827 which is not yet swaged.

Next, when the exposed parts of the first cable 200 and the second cables 300 are moved toward the corresponding holding portion set 821, the first cable 200 is accommodated in the cable holding portion 8205 through the opening 826 while the second cables 300 are brought into contact with the second cable holding portions 824, respectively, in the second direction.

When a force is applied to the exposed parts of the first cable 200 and the second cables 300 in this state so that the exposed parts of the first cable 200 and the second cables 300 approach the corresponding holding portion set 821 in the second direction, the coupling portions 400 are elastically deformed so that a distance between the second cables 300 in the first direction is reduced. Then, the second cables 300 are accommodated in the cable holding portion 8205 through the opening 826. Meanwhile, the first cable 200 is held by the first cable holding portion 822 while the second cables 300 are held by the second cable holding portions 824, respectively.

Also meanwhile, the cable assembly 100 is accommodated in the corresponding cable assembly holding portion 827 through the opening (not shown). After that, the cable assembly holding portion 827 is swaged and thereby the cable assembly 100 is held by the corresponding cable assembly holding portion 827. Thus, the cable assemblies 100 are attached to the first member 820.

Then, the second member 840 is positioned relative to the first member 820 and the cable assemblies 100 so that the terminal set 831 is positioned outward in the second direction beyond the first cable 200 and the second cables 300 of the corresponding cable assembly 100. Meanwhile, the connecting portion 8326 of the first terminal 832 of the terminal set 831 is positioned outward in the second direction beyond the first cable 200 of the corresponding cable assembly 100 while the connecting portions 8346 of the second terminals 834 of the terminal set 831 are positioned outward in the second direction beyond the second cables 300, respectively, of the corresponding cable assembly 100.

After that, the second member 840 is moved toward the first member 820 in the second direction. Then, the connecting portion 8326 of the first terminal 832 of the terminal set 831 of the second member 840 is brought into contact with the first cable 200 of the corresponding cable assembly 100 through the opening 826 in the second direction, while the connecting portions 8346 of the second terminals 834 of the terminal set 831 of the second member 840 are brought into contact with the second cables 300, respectively, of the corresponding cable assembly 100 through the opening 826 in the second direction.

Under this state, a force is applied to the second member 840 so that the second member 840 and the first member 820 further approach each other in the second direction. Then, the connecting portion 8326 of the first terminal 832 of the terminal set 831 of the second member 840 pierces the first cover 220 of the first cable 200 of the corresponding cable assembly 100 and is connected with the first conductor 210, while the connecting portions 8346 of the second terminals 834 of the terminal set 831 of the second member 840 pierce the second covers 320 of the second cables 300, respectively, of the corresponding cable assembly 100 and are connected with the second conductors 310, respectively. Consequently, the cable assemblies 100 are attached to the connector 810.

Although the specific explanation about the present invention is made above referring to the embodiments, the present invention is not limited thereto and is susceptible to various modifications and alternative forms.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A cable assembly extending in a longitudinal direction, wherein:

the cable assembly comprises a first cable, two second cables, two coupling portions, an interposing portion and an outer cover;

the first cable has a first conductor and a first cover;

the first cover covers the first conductor;

the two second cables are positioned apart from each other in a first direction perpendicular to the longitudinal direction;

each of the second cables is positioned apart from the first cable in a second direction perpendicular to both the longitudinal direction and the first direction;

each of the second cables has a second conductor and a second cover;

the second cover covers the second conductor;

the coupling portions couple the second covers, respectively, with the first cover;

the first cable, the two second cables and the two coupling portions are arranged in a V-shape in a plane perpendicular to the longitudinal direction;

the interposing portion extends along the first cable and the two second cables and has a full length which is equal to that of each of the first cable and the two second cables;

the interposing portion is brought into contact with all the first cable and the two second cables; and the outer cover is brought into contact with all the first cable and the two second cables.

2. The cable assembly recited in claim 1, wherein:

the interposing portion has a cross-section perpendicular to the longitudinal direction;

the first cable has a cross-section perpendicular to the longitudinal direction;

a size of the cross-section of the interposing portion is smaller than a size of the cross-section of the first cable;

each of the second cables has a cross-section perpendicular to the longitudinal direction; and the size of the cross-section of the interposing portion is smaller than a size of the cross-section of the second cable.

3. The cable assembly as recited in claim 1, wherein:

a center of the interposing portion is positioned between the second conductors of the second cables in the first direction; and the center of the interposing portion is positioned between a line and a center of the first conductor in the second direction, the line connecting centers of the second conductors of the second cables with each other.

4. The cable assembly as recited in claim 3, wherein:

the cable assembly has a first distance which is a shortest distance through the center of the first conductor from the center of the interposing portion to the outer cover in the second direction;

the cable assembly has a second distance which is a shortest distance from the center of the interposing portion to the outer cover without passing through the first conductor in the second direction; and the first distance is greater than the second distance.

5. The cable assembly as recited in claim 1, wherein the interposing portion has a cylindrical shape.

* * * * *